US005326329A

United States Patent [19]

Doss

[11] Patent Number: 5,326,329

[45] Date of Patent: Jul. 5, 1994

[54] JUMP-SHOT POOL CUE

[76] Inventor: Robert J. Doss, P.O. Box 238, Seward, Nebr. 68434

[21] Appl. No.: 59,842

[22] Filed: May 11, 1993

[51] Int. Cl.[5] ..... A63D 15/08

[52] U.S. Cl. ..... 473/47; 473/44

[58] Field of Search ..... 273/68; 473/45, 46, 473/47, 48

[56] References Cited

U.S. PATENT DOCUMENTS

| | | | |
|---|---|---|---|
| 692,970 | 2/1902 | Zaehringer | 273/68 |
| 784,090 | 3/1905 | Whitehouse | 273/68 |
| 1,609,026 | 11/1926 | Lindley . | |
| 3,342,489 | 9/1967 | Waldo . | |
| 3,372,932 | 3/1968 | Molis . | |
| 3,392,976 | 7/1968 | Hayes . | |
| 3,468,538 | 9/1969 | Johnson . | |

FOREIGN PATENT DOCUMENTS

| | | | |
|---|---|---|---|
| 77154 | 10/1894 | Fed. Rep. of Germany | 273/68 |

*Primary Examiner*—Mark S. Graham
*Attorney, Agent, or Firm*—Henderson & Sturm

[57] ABSTRACT

This invention relates to an apparatus for causing a pool cue ball to jump and thereby avoid an opponent's safety blocking ball utilizing a cue stick of approximately one half of the standard length, and having a plurality of apertures within a carrier in a radial slot in the handle end of the stick wherein selected weights may be secured to adjust the weight of the stick for different shooting styles and for different weights of cue balls.

2 Claims, 2 Drawing Sheets

JUMP-SHOT POOL CUE

TECHNICAL FIELD

This invention relates to pool cues, and more particularly to a pool cue specifically designed for causing a pool cue ball to jump.

BACKGROUND ART

Numerous designs for pool cues and billiard cues are well known in the art. These designs include the metallic billiard cue of Lindley, U.S. Pat. No. 1,609,026; the weighted billiard cue of Waldo, U.S. Pat. No. 3,342,489; the billiard cue having an adjustable center of gravity of Molis, U.S. Pat. No. 3,372,932; and the weighted billiard cue of Johnson, U.S. Pat. No. 3,468,538. These references, however, teach variations of the standard cue stick and do not meet the unique requirements of a cue stick to be used for jump shots. This is of course due to the fact that jump shots have not traditionally been used in billiards and pool. However, the use of blocking shots in safety play has become more popular recently, with a resulting increase in the use of jump shots to defeat the block.

DISCLOSURE OF THE INVENTION

The present invention relates to a method and apparatus for causing a pool cue ball to jump and thereby avoid an opponent's safety blocking ball. Ordinary pool cues are much too long and unwieldy to be used in jump shots with any consistency in accuracy. Further, it is important that the weight of the stick be adjustable to accommodate different playing conditions. This invention utilizes a cue stick of approximately one half of the standard length, and has a plurality of apertures within the handle end of the stick wherein selected weights may be secured to adjust the weight of the stick for different shooting styles and for different weights of cue balls. The method entails elevating the cue above the cue ball at approximately a forty five degree angle to the table and thrusting the cue downward with one hand as the cue slides through the fingers of the opposite hand.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
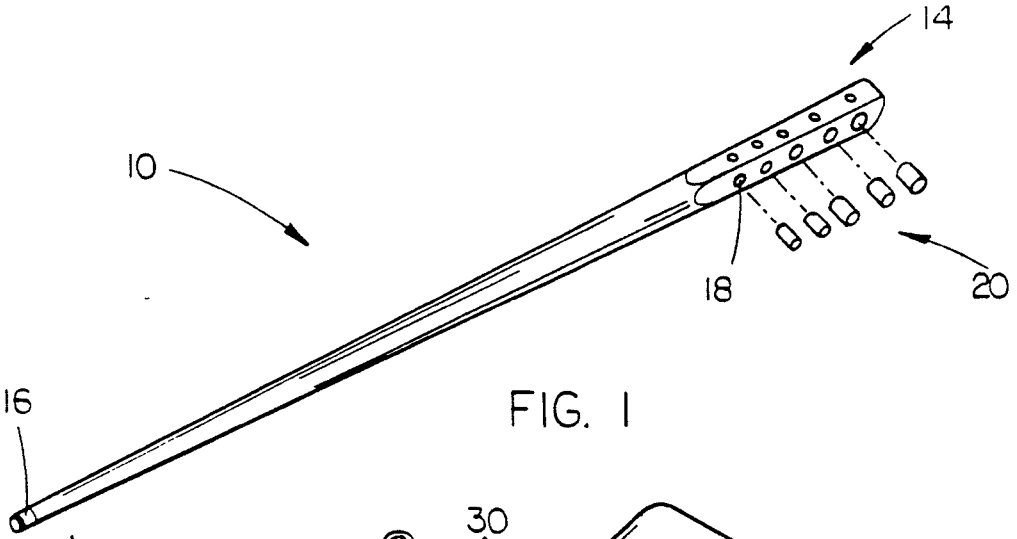
FIG. 1 is a perspective view of a first embodiment of the invention.
Figure 2:
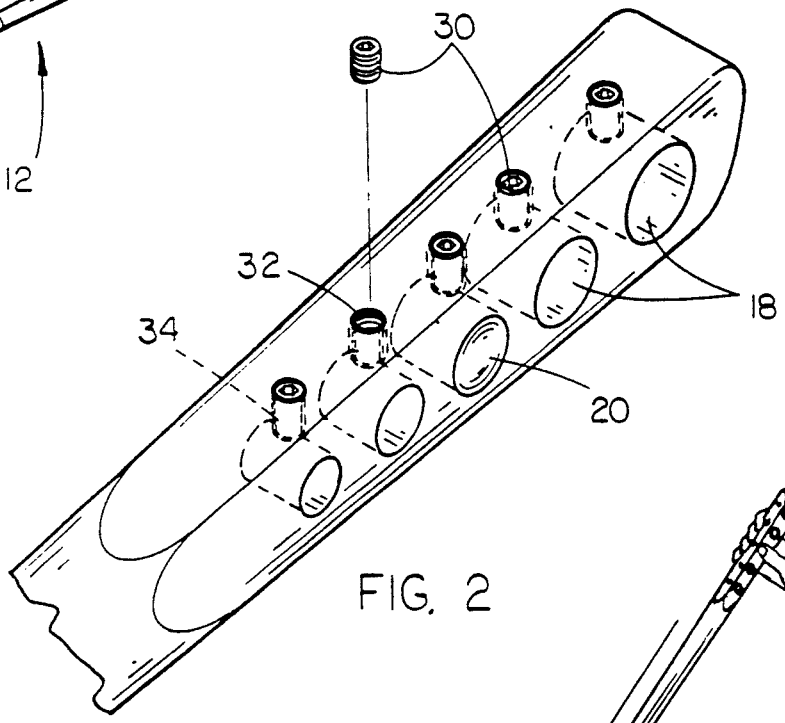
FIG. 2 is an enlarged perspective view of the handle end of the first embodiment.

Referring now to the drawings, wherein like reference numerals designate identical or corresponding parts throughout the several views, FIG. 1 depicts a first embodiment of the invention 10, which comprises an elongate member having a length of approximately thirty inches with a striking end 12 and a handle end 14. The striking end 12 has a circular cross-section as is standard in the art, while the handle end 14 has a rectangular cross section of a somewhat larger cross-sectional area. These differing cross-sectional shapes gradually evolve into each other as the length of the stick is traversed. The striking end 12 is provided with a standard cue tip 16, well known in the art, while the handle end 14 has a series of holes 18, preferably four or five in number, drilled through it. Referring now to FIG. 2, it may be seen that the holes 18 are of different diameters, ranging from approximately three quarters of an inch down to approximately three eights of an inch. Also provided is a series of cylindrical weights 20, graduated in their diameters so as to fit within their respective holes 18. Once a weight 20 is placed within its respective hole 18, it is then secured into position by means of a set screw 30, passing through a threaded set screw housing 32 which radially engages each of the apertures 18. The set screw housings 32 are permanently affixed within holes 34 drilled into handle 14 radial to the apertures 18.

Figure 3:
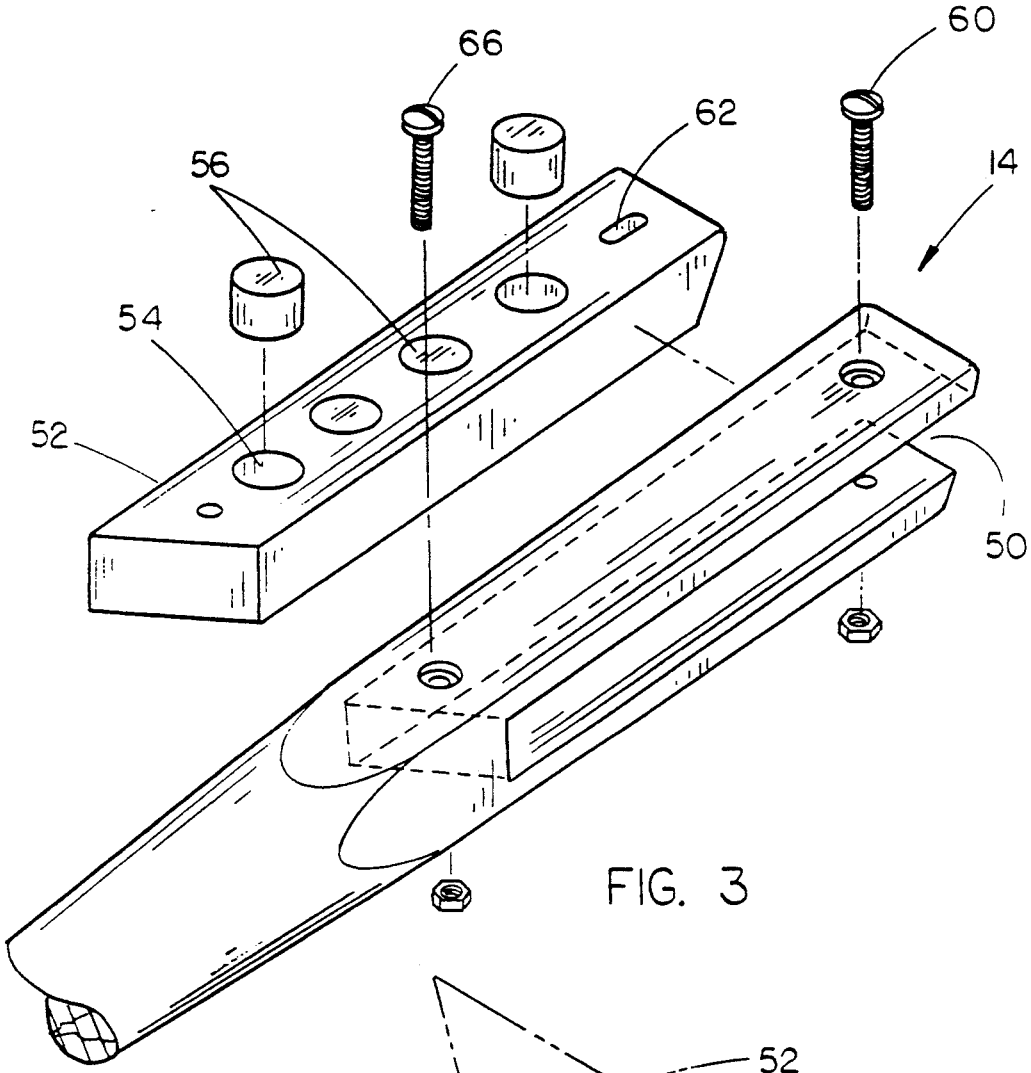
FIG. 3 is an exploded, perspective view of the handle end of a second embodiment of the invention.
Figure 4:
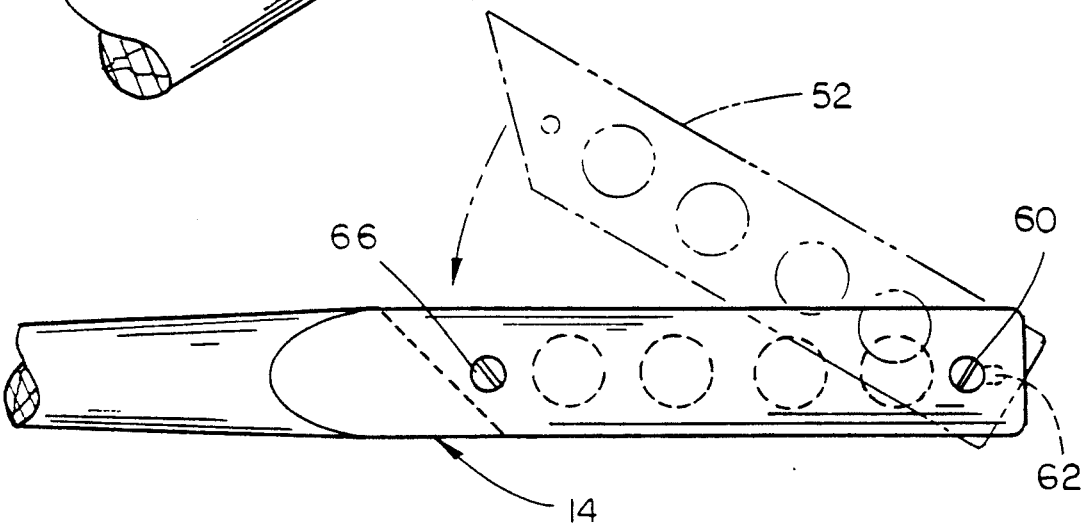
FIG. 4 is a side elevational view of the handle of a second embodiment.

A second embodiment of the invention is depicted in FIG. 3 and FIG. 4. In this embodiment, the handle end 14 has a slot 50 cut through from one side to the opposite side into which rotates a weight carrier 52. The weight carrier 52 has a series of holes 54 drilled through it to receive one or more weights 56. The weight carrier 52 is rotatably secured to the handle 52 by means of a bolt 60 which passes through the handle and through an oblong aperture 62 drilled through the weight carrier. When the weight carrier has been rotated within the handle, it is then secured into position by a second bolt 66.

Figure 5:
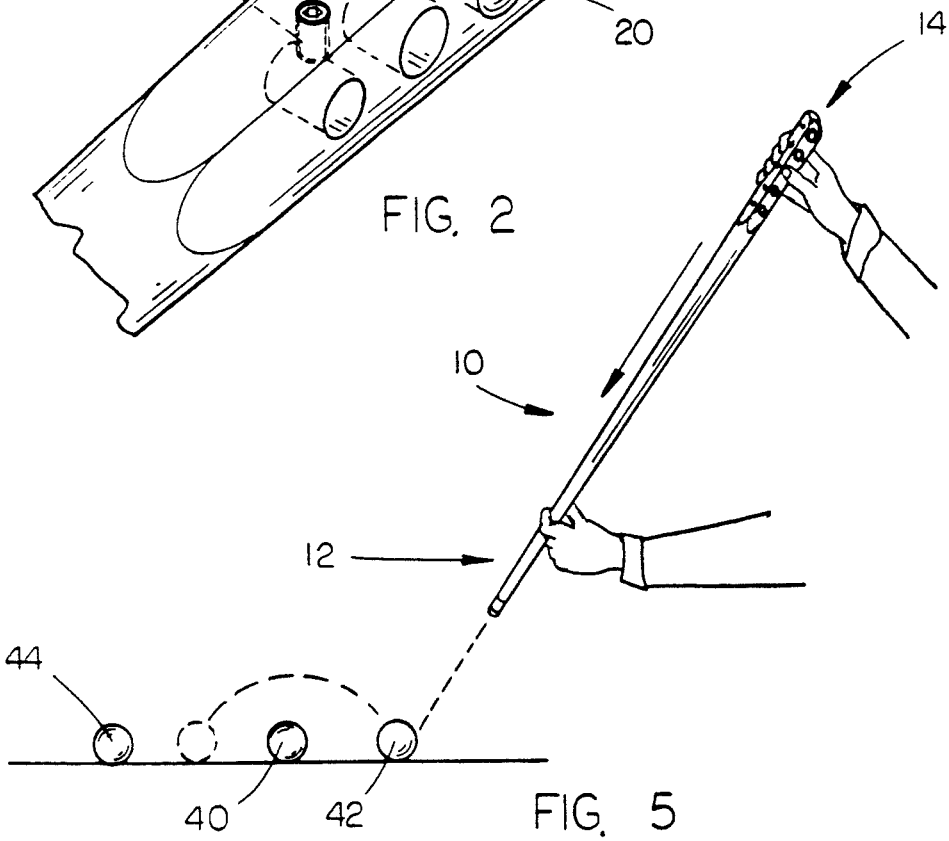
FIG. 5 is a perspective view of the method of the invention.

The jump-shot pool cue is used as depicted in FIG. 5 where an opponent's blocking ball 40 has been positioned between the cue ball 42 and the object ball 44. The cue stick is held above the cue ball to be struck and offset therefrom at approximately a forty five degree angle to the pool table. For a right-handed player, the handle end 14 would typically be grasped between the thumb and index finger of the right hand, with the index finger of the left hand encircling the striking end 12 of the cue. With the cue ball 42 properly lined up with the object ball 44, the player thrusts and releases the cue stick with the right hand while guiding its motion with the left hand such that the cue ball is struck so as to make it hop off of the table. The cue ball thus avoids the blocking ball 40 and strikes the object ball 44.

Obviously, many modifications and variations of the present invention are possible in light of the above teachings. For example the weights of the first embodiment could be secured within the pool cue in many different ways other than set screws, such as snap rings, resilient weight retainers within the stick, or threaded retainers to receive a threaded weight. The shape of the cue stick could also be modified in many different ways. It is therefore to be understood that, within the scope of the appended claims, the invention may be practiced otherwise than as specifically described.

I claim:

1. A pool cue stick for causing a pool cue ball to jump, comprising:

(a) an elongate body with a length of approximately thirty inches, said body having a first end and a second end, said first end having a cue tip secured thereto, said second end having a means for adjusting the weight of the cue stick comprising a weight carrier having a series of weight receiving apertures therein, and a radial slot cut through said second end of said elongate body, said weight carrier sized to fit within said radial slot; and (b) a plurality of cylindrical weights sized to fit within said apertures.

2. The pool cue stick as recited in claim 1 wherein said weight carrier is rotatably secured to said second end.

* * * * *